US006405901B1

(12) United States Patent
Schantz et al.

(10) Patent No.: US 6,405,901 B1
(45) Date of Patent: Jun. 18, 2002

(54) VALVE WITH ROLLING SLEEVE

(75) Inventors: Daniel G. Schantz, Muskego, WI (US); Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/748,629

(22) Filed: Dec. 22, 2000

(51) Int. Cl.[7] ..... B65D 37/00

(52) U.S. Cl. ..... 222/213; 222/92; 222/490; 222/494

(58) Field of Search ..... 222/92, 212–214, 222/490, 494

(56) References Cited

U.S. PATENT DOCUMENTS

| | | | | |
|---|---|---|---|---|
| 1,206,661 A | | 11/1916 | Booth | |
| 1,825,553 A | * | 9/1931 | Smith | 222/490 |
| 1,989,714 A | | 2/1935 | Statham | |
| 2,175,052 A | | 10/1939 | Bull et al. | |
| 2,209,665 A | * | 7/1940 | Scheringer | 222/494 |
| 2,758,755 A | | 8/1956 | Schafler | |
| 3,063,601 A | | 11/1962 | Hertz | |
| 3,342,379 A | | 9/1967 | Foley | |
| 3,490,488 A | | 1/1970 | Grist | |
| 4,166,553 A | | 9/1979 | Fraterigo | |
| 4,408,702 A | | 10/1983 | Horvath | |
| 4,434,810 A | | 3/1984 | Atkinson | |
| 4,470,523 A | | 9/1984 | Spector | |
| 4,728,006 A | | 3/1988 | Drobish et al.. | |
| 4,749,108 A | | 6/1988 | Dornsbusch et al. | |
| 4,794,750 A | | 1/1989 | Schmidt et al. | |
| 4,987,740 A | | 1/1991 | Coleman | |
| 4,991,745 A | | 2/1991 | Brown | |
| 5,033,655 A | | 7/1991 | Brown | |
| 5,071,017 A | | 12/1991 | Stull | |
| 5,115,950 A | | 5/1992 | Rohr | |
| 5,213,236 A | | 5/1993 | Brown et al. | |
| 5,271,531 A | * | 12/1993 | Rohr et al. | 222/212 |
| 5,307,955 A | | 5/1994 | Viegas | |
| 5,339,995 A | | 8/1994 | Brown | |
| 5,377,877 A | | 1/1995 | Brown et al. | |
| 5,390,805 A | * | 2/1995 | Bilani et al. | 222/490 |
| 5,409,144 A | | 4/1995 | Brown | |
| 5,439,143 A | | 8/1995 | Brown et al. | |
| 5,472,123 A | | 12/1995 | Jangaard | |
| 5,839,614 A | | 11/1998 | Brown | |
| 5,924,605 A | * | 7/1999 | Baudin et al. | 222/494 |
| 6,065,642 A | | 5/2000 | Brown | |
| 6,089,411 A | * | 7/2000 | Baudin et al. | 222/212 |
| 6,112,951 A | * | 9/2000 | Mueller | 222/490 |

FOREIGN PATENT DOCUMENTS

| | | |
|---|---|---|
| WO | WO 97/09245 | 3/1997 |
| WO | WO 98/14386 | 4/1998 |
| WO | WO 99/10247 | 3/1999 |

OTHER PUBLICATIONS

U.S. patent application Ser. No. 09/274,396, filed Mar. 23, 1999.

U.S. patent application Ser. No. 08/886,567, filed Jul. 1, 1997.

* cited by examiner

*Primary Examiner*—J. Casimer Jacyna
(74) *Attorney, Agent, or Firm*—Wood, Phillips, Katz, Clark & Mortimer

(57) ABSTRACT

A dispensing valve for dispensing a product from a container. The valve includes a marginal portion, a head portion with a discharge orifice therein, and a resilient, flexible, connector sleeve extending continuously laterally and inwardly from the marginal portion to the head portion. The head portion has an exterior side for interfacing with ambient environment and a peripheral surface. The connector sleeve is connected to the exterior side of the head portion at the peripheral surface of the head portion.

16 Claims, 3 Drawing Sheets

VALVE WITH ROLLING SLEEVE

CROSS REFERENCE TO RELATED APPLICATION

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a valve for dispensing a product from a container. The valve is especially suitable for use in a dispensing closure for a flexible container which is squeezable.

BACKGROUND OF THE INVENTION AND TECHNICAL PROBLEMS POSED BY THE PRIOR ART

There are a wide variety of packages which include (1) a container, (2) a dispensing system extending as a unitary part of, or attachment to, the container, and (3) a product contained within the container. One type of such a package employs a dispensing valve for discharging one or more streams of product (which may be a liquid, cream, or particulate product). See, for example, U.S. Pat. No. 5,839,614 assigned to AptarGroup, Inc. The package includes a flexible, resilient, self-sealing, slit-type valve at one end of a generally flexible bottle or container. The valve is normally closed and can withstand the weight of the product when the container is completely inverted, so that the product will not leak out unless the container is squeezed. When the container is squeezed and the interior is subjected to a sufficient increased pressure so that there is a predetermined pressure differential across the valve, the valve opens. In the preferred embodiment, the valve stays open, at least until the container pressure drops below a predetermined value. In accordance with the preferred embodiments disclosed in the U.S. Pat. No. 5,839,614, the valve can be designed to snap closed if the pressure differential across the open valve drops below a predetermined amount. The valve can also be designed to open inwardly to vent air into the container when the pressure within the container is less than the ambient external pressure, and this accommodates the return of the resilient container wall from an inwardly squeezed condition to the normal, unstressed condition.

It would be desirable to provide an improved valve for a dispensing system that would beneficially allow the user to easily locate the valved discharge end of the inverted container over a receiving receptacle or other target area while minimizing product discharge messiness.

Such an improved valve should also facilitate the control and ease of dispensing the product when the interior of the container is pressurized (e.g., when the container is squeezed or when the container internal pressure is increased by other means).

It would also be advantageous if such an improved valve could accommodate use with bottles, containers, or packages that have a variety of shapes and that are constructed from a variety of materials.

Further, it would be desirable if such an improved valve could accommodate efficient, high-quality, large-volume manufacturing techniques with a reduced product reject rate to produce a valve with consistent operating characteristics.

The present invention provides an improved dispensing valve which can accommodate designs having the above-discussed benefits and features.

BRIEF SUMMARY OF THE INVENTION

The present invention provides a valve for dispensing a product from a container, and the valve opens once the container interior pressure increases to establish a predetermined pressure differential across the valve. The valve can accommodate discharge of liquids, creams, or particulate matter, including powders.

The valve is adapted for use in dispensing a product from a container having an opening. The valve may be formed as a unitary part of an end of such a container or may be mounted in a separate assembly that is permanently or releasably attached to the container.

The preferred form of the valve is adapted for being sealingly disposed with respect to, and dispensing the product from, the discharge opening of the container. The valve includes a marginal portion adapted to be sealingly engaged when the valve is sealingly disposed with respect to the container discharge opening. The valve also includes a head portion that (1) is laterally inwardly of the marginal portion, (2) has an exterior side for interfacing with ambient environment, and (3) has an interior side for interfacing with the product. A portion of the valve head interior side defines an outer peripheral surface of the valve head corresponding to the thickness at the periphery of the valve head.

The head portion also includes a normally closed orifice which opens to permit flow therethrough in response to a pressure differential across the valve. In the preferred embodiment, the orifice is defined by a plurality of slits that extend (1) through the head portion between the exterior side and the interior side, and (2) laterally from a common origin whereby flaps are defined by the slits with each slit terminating in an outer end. The orifice opens by outward displacement of the flaps when the pressure in the interior of the container exceeds the pressure on the exterior of the valve by a predetermined amount.

According to a preferred embodiment, the head portion of the closed valve may also be characterized as having a generally concave shape when viewed from outside the container. The head portion interior side preferably has a planar central area and a generally curved, radially outer portion which tapers toward the planar central area such that the exterior and interior sides converge toward the planar central area to provide a tapered construction with reduced thickness.

In a preferred embodiment, the valve also has a resilient, flexible, connector sleeve. The connector sleeve extends continuously laterally and inwardly from the marginal portion to the exterior side of the head portion at the peripheral surface thereof. The connector sleeve preferably has a generally curved radius of about a 45 degree angle to the pressure that is applied to it. In so doing, the resistance to the force that is applied to the connector sleeve is weakened causing it to buckle under a lower pressure than other types of slit valves. Since the connecting sleeve is weaker, it is possible to make it thicker. In accordance with a preferred embodiment, the connecting sleeve is about 0.011 inches in thickness.

The valve design of the present invention is applicable for use with a wide range of products from powder, shampoo and baby oil to honey and seasonings. The valve design is particularly applicable for dispensing granular products like seasoning, spices and the like.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

Figure 1:
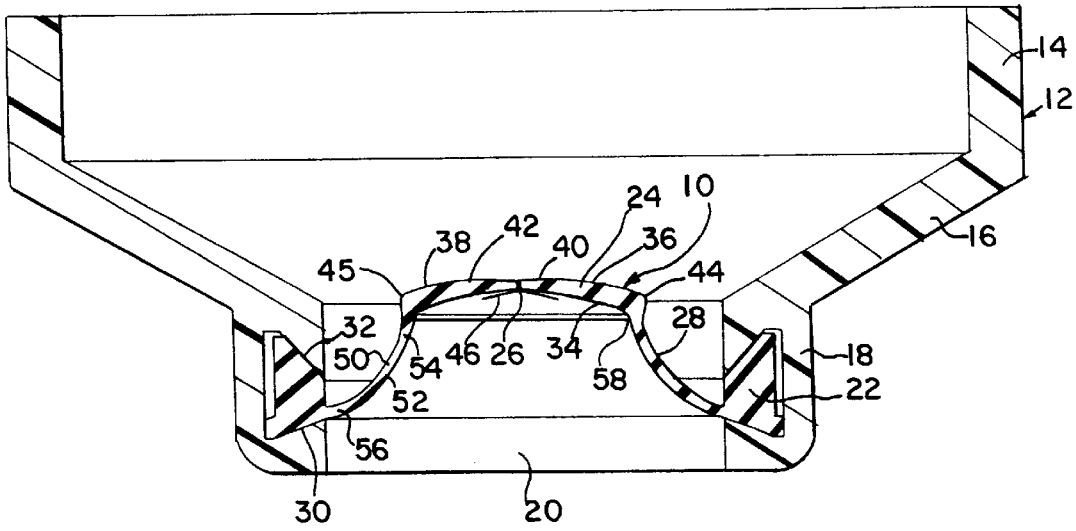
FIG. 1 is a cross-sectional view of a dispensing closure having a dispensing valve in accordance with the present invention, with the valve shown in the fully closed and fully retracted position.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing valve of this invention is described in the typical orientation that it would have at the top of a container when the container is stored upright on its base, and terms such as upper, lower, horizontal, etc., are used with reference to this position. It will be understood, however, that the dispensing valve of this invention may be manufactured, stored, transported, used, and sold in an orientation other than the position described.

The dispensing valve of this invention is suitable for use with a variety of conventional or special containers and closures having various designs, the details of which, although not illustrated or described, would be apparent to those having skill in the art and an understanding of such containers and closures. The container per se (and closure, if used) forms no part of the present invention.

The presently preferred embodiment of the dispensing valve is generally designated in the Figures by the reference number 10. Valve 10 is mounted in a dispensing closure 12 for a container (not shown), but may be mounted directly to a container as discussed hereinafter.

As can be seen in FIGS. 1–5, closure 12 has a base or skirt 14, an annular shoulder 16 extending radially inwardly from the top of skirt 14, and a reduced diameter neck or spout 18 extending upwardly from the inner portion of shoulder 16 to define an opening 20.

The interior of skirt 14 can define a thread (not shown). Skirt 14 is adapted to receive the upper end of the neck of a container (not shown), and the skirt thread is adapted to matingly engage a thread on the neck of a container.

Alternatively, instead of closure 12 having skirt 14, closure 12 could be provided with some other container connecting means, such as a snap-fit bead (not shown) in place of thread for engaging a mating groove (not shown) in the neck of a container. Closure 12 could also be permanently fixed to a container by means of induction melting, ultrasonic melting, gluing, or the like, depending on the materials used for the closure and the container.

Closure 12 could also be formed as a unitary part, or extension, of a container. In some applications, it may be desirable to eliminate the closure altogether, and instead attach valve 10 directly to a spout of a container or to some other structural feature of a container which defines an opening. Valve 10 could be attached directly to a container with adhesive, or with bi-injection molding, or as a structure unitarily molded with a container, or with other suitable means.

Closure skirt 14 may have any suitable configuration. The container could have any suitable structure for being received within the particular configuration of closure 12, and the main part of the container may have a different cross-sectional shape than the container neck and closure skirt 14.

Closure 12 is adapted to be used with a container having a mouth or other opening to provide access to the container interior and to a product contained therein. The product may be, for example, a liquid comestible product. The product could also be any other liquid, solid, or gaseous material, including, but not limited to, a powder, particulate material, a food product, a personal care product, an industrial or household cleaning product, or other chemical compositions (e.g., compositions for use in activities involving manufacturing, commercial or household maintenance, construction, agriculture, etc.).

The container would typically be a squeezable container having a flexible wall or walls which can be grasped by the user and squeezed or compressed to increase the internal pressure within the container so as to force the product out of the container and through closure 12. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and pressurize the container interior at selected times with a piston or other pressurizing system.

Although not shown, a conventional, annular, "crab's claw" seal, or other type of conventional or special seal, could be provided to project downwardly from the inside of the closure to sealingly engage an annular top portion of a container adjacent the opening in the container.

Valve 10 can be retained within closure 12 by suitable means, including, for example, one or more deformed or molded retention flanges on the closure or with a retainer ring (not shown) which can be positioned inside the closure in a snap-fit engagement or which can be otherwise secured in the closure. The valve 10 could also be clamped directly between the top of the container and the closure. Alternatively, the container top portion could be molded as a closure unitary with the container, and the valve could be suitably secured in the container closure end by inserting and attaching the valve through an open bottom end of the closure that is thereafter closed by other suitable means.

As shown in FIGS. 1–5, valve 10 includes a marginal portion or flange 22, a valve head 24 with a discharge orifice 26 therein, and a connector sleeve 28, which has one end connected with valve flange 22 and the opposite end connected with valve head 24 adjacent a marginal edge thereof.

The connector sleeve 28 has a resiliently flexible construction, such that when pressure within a container is increased sufficiently, valve head 24 shifts outwardly to a fully extended position where valve 10 becomes fully opened to accommodate discharge of the container contents.

With reference to FIGS. 1–5, the illustrated dispensing valve 10 has an integrally formed or unitary, one-piece construction. Valve 10 has an interior side which interfaces with the fluid product in a container. Valve 10 has an oppositely oriented exterior side which interfaces with ambient environment. Valve 10 is preferably molded from a resiliently flexible material, and in the illustrated example the material comprises a silicone rubber which is substantially inert so as to avoid reaction with, and/or adulteration of, the product being packaged. In one contemplated method of manufacturing valve 10 of the present invention, valve 10 is produced at relatively high speeds by the molding of liquid silicone rubber.

In the illustrated preferred embodiment, marginal flange 22 of valve 10 has an annular plan shape, and valve flange 22 has a substantially dovetail cross-sectional configuration with an outer or first frustoconical surface 30, and an inner or second frustoconical surface 32. The marginal valve flange 22 has substantial thickness between the outer, or first, frustoconical surface 30 and the inner, or second, frustoconical surface 32 which is resiliently compressed upon mounting the valve in a closure or between a closure and a container so as to form a secure leak-resistant seal therebetween.

The valve 10 has a head portion 24 which has a circular plan shape, and a generally tapered construction which is thicker at the radially outside portion of valve head 24, and thinner at the radially inside portion thereof. This tapered construction assists in achieving the snap open action of valve 10, as described below. More specifically, in the illustrated example, valve head 24 has an exterior side or surface 34 for interfacing with the ambient environment. Exterior surface 34 has an arcuately shaped side elevational configuration which opens or curves outwardly, toward the exterior of a container, and surface 34 is defined by a first predetermined radius. Valve head exterior surface 34 extends continuously to the interior sidewall of connector sleeve 28, which extends from the periphery of head 24 to marginal portion 22.

Valve head 24 also includes an interior side or surface 36 for interfacing with the product in a container. The valve head interior side surface 36 has a marginal portion 38 with an arcuately shaped side elevational configuration which opens or curves outwardly, toward the exterior of a container, and is defined by a second predetermined radius. The radius of marginal portion 38 on interior surface 36 is larger than radius of exterior surface 34, such that the two surfaces converge toward the center of valve head 24 at the center of orifice 26, and provide the above-noted inwardly tapered construction of valve head 24. The exterior surface radius and the interior surface radius may each be characterized as a spherical radius.

Interior surface 38 of valve head 24 also includes a center portion or planar central area 40, which has a circular plan shape, with a substantially planar or flat side elevational configuration, oriented generally perpendicularly to discharge orifice 26. The intersection of the valve head marginal portion 38 and planar central portion 40 of valve head 24 defines a circular locus 42. Planar central portion 40 of valve head 24 assists in improving the opening characteristic of valve 10, as set forth below.

In the illustrated embodiment, the outer perimeter of valve head 24 is preferably defined by frustoconical peripheral surface or marginal surface 44 which begins at a peripheral outer edge 45 of the head marginal portion 38, and extends outwardly therefrom with a slight taper, ultimately merging into connector sleeve 28. Edge 45 may be characterized as a side circular, peripheral edge. The outside diameter of valve head 24, as measured along peripheral edge 45, is substantially smaller than the inside diameter of marginal flange 22. This spacing between valve head 24 and marginal flange 22 permits, among other things, valve head 24 to shift freely in an axial direction through the center of marginal flange 22.

In the illustrated preferred embodiment, valve 10 has a generally circular configuration about a longitudinal axis extending through valve 10, and orifice 26 is defined by a plurality of slits 46 radiating laterally from the longitudinal axis. Preferably, there are four slits 46. A lesser or greater number of slits could be used. Slits 46 extend transversely through valve head portion 24 from exterior side or surface 34 to interior side or surface 36.

In the illustrated preferred embodiment, slits 46 extend laterally from a common origin on the longitudinal axis to define four flaps 48 (FIGS. 5 and 6) which flex outwardly to selectively permit the flow of product from a container through valve 10. Each slit 46 terminates in a radially outer end. In the illustrated preferred embodiment, the slits 46 are of equal length, although the slits could be of unequal length.

In the preferred embodiment, each slit 46 is planar and parallel to the central geometric axis of the valve. Each slit 46 preferably defines a linear locus along the head portion exterior side 34 and along the head portion interior side 36. Preferably, the slits 34 diverge from an origin on the longitudinal axis and define equal size angles between each pair of adjacent slits 46 so that flaps 48 are of equal size. Preferably, four slits 46 diverge at 90° angles to define two mutually perpendicular, intersecting, longer slits. Slits 46 are preferably formed in the valve head 24 so that the opposing side faces of adjacent valve flaps 48 closely seal against one another when discharge orifice 26 is in its normal, fully closed position. The length and location of slits 46 can be adjusted to vary the predetermined opening pressure of valve 10, as well as other dispensing characteristics.

It is to be understood that orifice 26 may assume many different shapes, sizes and/or configurations in accordance with those dispensing characteristics desired. For example, orifice 26 may also include five or more slits, particularly when larger or wider streams are desired, and/or the product is a particulate material or a liquid containing aggregates.

The connector sleeve 28 is in the form of a rolling diaphragm, having a hollow-circular plan configuration, and a generally arcuately shaped longitudinal cross-section. In the preferred embodiment, the connector sleeve 28 preferably has a generally curved radius of about a 45 degree angle to the general direction of flow through the valve when pressure is applied to it, although a greater or lesser angle may be employed. Connector sleeve 28 has an interior surface 50 and an exterior surface 52, which are preferably spaced equidistantly apart along the length thereof, such that connector sleeve 28 has a substantially uniform thickness. In accordance with a preferred embodiment, the thickness is about 0.011 inches. In an alternate design, the sleeve may have a non-uniform thickness and/or a different thickness depending upon the type of product to be dispensed and/or upon the overall diameter or size of the valve.

One end portion 54 of connector sleeve 28 is connected with the exterior surface 34 of valve head 24 adjacent the marginal edge 46 thereof, and the opposite end portion 56 of connector sleeve 28 is connected with the marginal valve flange 22. The interior surface 50 of connector sleeve 28 adjacent end portion 54 is substantially contiguous with the marginal surface 44 of valve head 24, while the opposite end 56 of connector sleeve 28 is connected with marginal flange 22 such that it is substantially coplanar and contiguous with outer frustroconical surface 30 of marginal flange 22. The arcuate shape of connector sleeve 28 assists connector sleeve in rollingly extending as valve head 24 shifts outwardly in the manner described in greater detail below. The exterior surface 52 at end 54 of connector sleeve 28 intersects the exterior surface 34 of valve head 24 at an angle which defines a circular edge 58.

Dispensing valve 10 is preferably especially configured for use in conjunction with a particular container, and a specific type of product, so as to achieve the exact dispensing characteristics desired. For example, the viscosity and density of the fluid product are both important factors in designing the specific configuration of valve 10 for liquids, as is the shape, size, and strength of the container. The rigidity and durometer of the valve material, and size and shape of both valve head 24 and connector sleeve 28, are also important in achieving the desired dispensing characteristics, and can be matched with both the container and the material to be dispensed therefrom.

Valve 10 is suitable for dispensing flowable products, such as liquids or even powder, particles, or granular material, as well as suspensions of solid particles in a liquid. Valve 10 is particularly suitable for dispensing applicable for dispensing granular products, like seasoning, spices and the like.

It is to be understood that, according to the present invention, valve 10 may assume different shapes and sizes, particularly in keeping with the type of container and product to be dispensed therefrom. The predetermined opening pressure of valve 10 may be varied widely in accordance with those dispensing criteria desired for a particular product. Flow characteristics of the dispensed product can also be adjusted substantially, such as for relatively wide column-like streams, thin needle-like streams, and multiple streams, variations thereof, and the like.

In operation, closure 12 functions in the following manner. Valve 10 normally assumes an initial, fully closed and retracted orientation illustrated in FIG. 1, wherein valve 10 remains substantially in its original molded shape without deformation, with connector sleeve 28 being substantially unstressed and the discharge opening 26 being fully closed. When valve 10 is mounted in the top of a container, valve 10 is configured such that discharge orifice 26 will remain securely closed after the container is inverted, even under the hydraulic head pressure applied thereto by a fluid product when the container is completely full.

When additional pressure is established in the interior of the container, such as by manually flexing the container sidewalls inwardly, connector sleeve 28 begins to distort, and the valve head 24 begins to shift axially outwardly.

Figure 2:
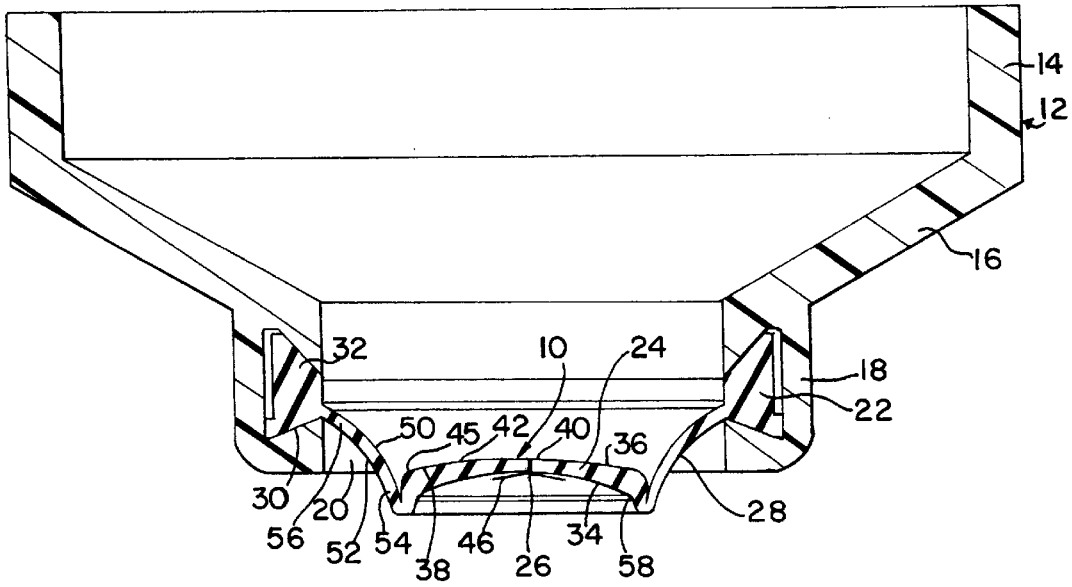
FIG. 2 is a cross-sectional view of the dispensing closure and dispensing valve, with the valve shown in the fully closed and partially extended position.

As the interior of the container is subjected to additional pressure, valve head 10 continues to move outwardly toward the exterior of dispensing closure 12 until connector sleeve 28 is substantially fully extended, as illustrated in FIG. 2. When valve head 10 is in the substantially fully extended position, the connector sleeve 28 is highly stressed.

Figure 3:
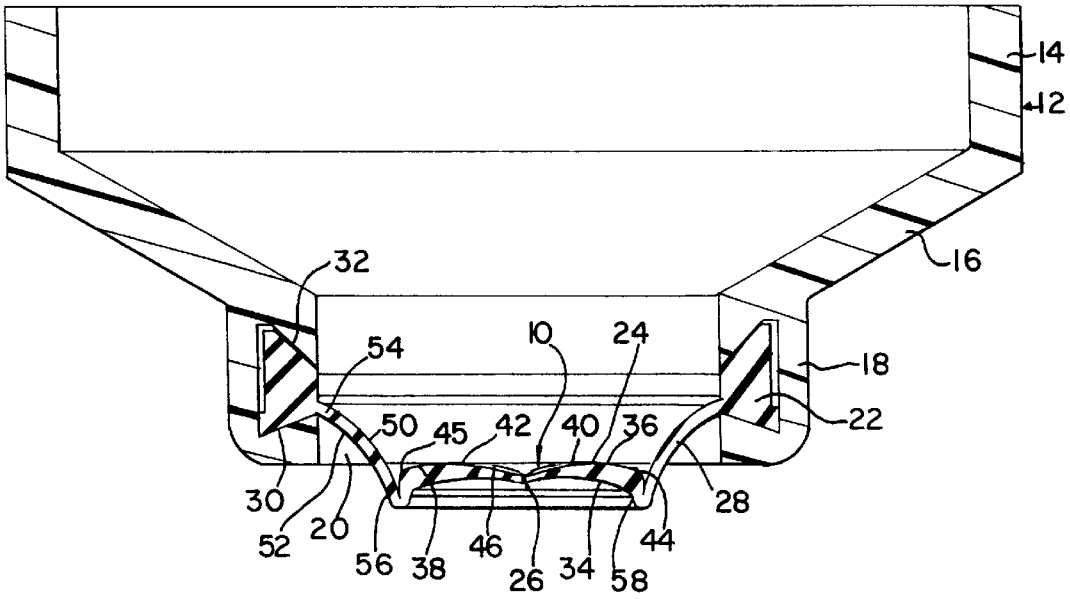
FIG. 3 is a cross-sectional view of the dispensing closure and dispensing valve, with the valve shown in the fully closed and fully extended position.

When the interior of the container is subjected to further increased pressure, valve head 10 continues to shift outwardly. However, because connector sleeve 28 is already substantially fully extended, further outward shifting of valve head 24 longitudinally tensions or stretches connector sleeve 28, thereby increasing the outwardly directed torque applied to valve head 24. Also, the further outward movement of valve head 24 tends to flatten or straighten valve head 24, particularly along the exterior surface 34 thereof (FIG. 3). This flattening motion tends to slightly enlarge or dilate the circular plan configuration of valve head 24, which enlargement is in turn resisted by radially inwardly directed forces applied to the marginal surface 44 of valve head 24 by connector sleeve 28, thereby generating another complex pattern of stresses within valve 10, and these include stresses which tend to compress valve head 24 in a radially inward direction. Due to the tapered shape of valve head 24, the majority of compression strain is believed to take place adjacent the planar central portion 40 of valve head 24.

Figure 4:
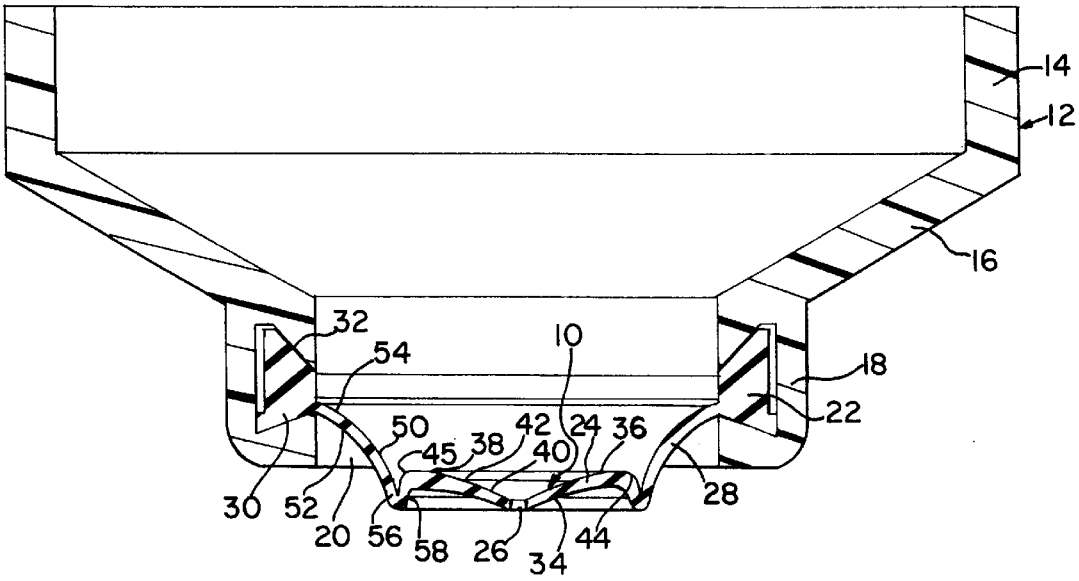
FIG. 4 is a cross-sectional view of the dispensing closure and dispensing valve, with the valve shown in the extended position, wherein the valve head portion thereof is shown beginning to snap outwardly.

When additional pressure is applied to the interior of the container, as illustrated in FIG. 4, valve head 24 continues to shift outwardly by further longitudinal stretching of connector sleeve 28, and further enlargement of the plan shape of valve head 24. In FIG. 4, the marginal edge 45 of valve head 24 is shown more bent or elastically deformed inwardly, as a consequence of the increased torque forces applied thereto by connector sleeve 28. These combined forces and motions also serve to further compress valve head 24 into a state of bifurcation, wherein the combined forces acting on valve head 24 will, upon application of any additional outward force on the interior side 36 of valve 10, cause valve 10 to quickly open outwardly by separating the valve flaps 48 in the manner illustrated in FIG. 5, and thereby dispense the product through discharge orifice 26 (FIG. 6). Valve 10 continues to open to the full open configuration shown.

The bifurcation state of valve 10, as the term is used herein, defines a relatively unstable condition which valve 10 assumes immediately prior to valve flaps 48 starting to open. As valve 10 passes through the bifurcation state, the combined forces acting on valve head 24 are in a temporary, unstable condition of equilibrium, and then quickly shift valve head 24 into a generally convex shape, simultaneously opening the valve flaps to create the open orifice. In the bifurcation state, valve head 24 assumes the shape of a nearly planar disc, but with exterior surface 34 cupped inwardly and the interior surface 36 is bent slightly outwardly.

Figure 5:
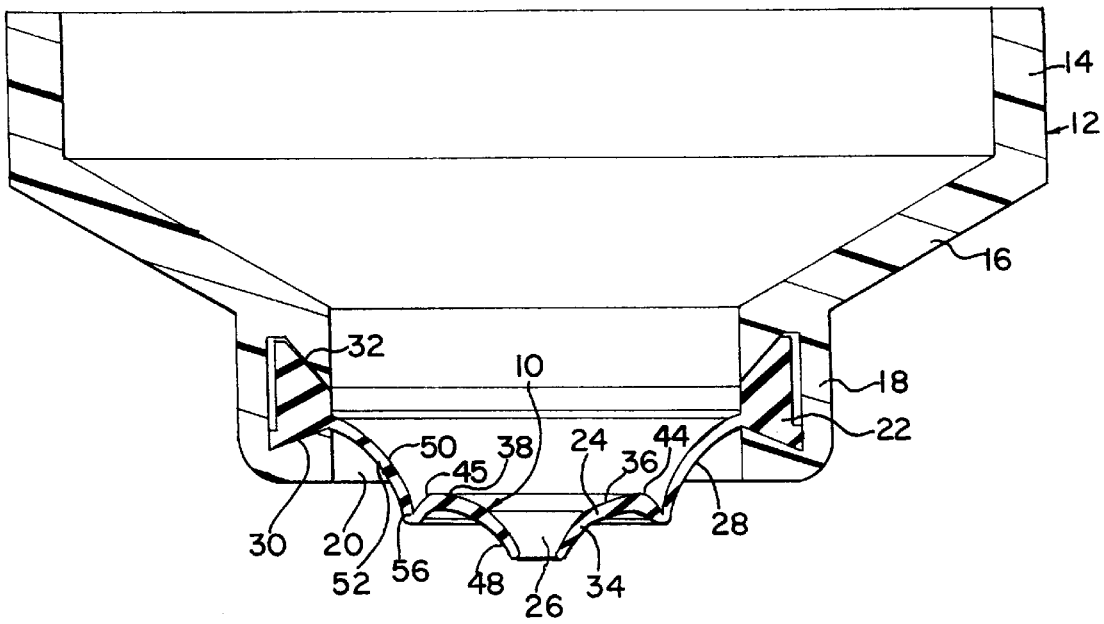
FIG. 5 is a cross-sectional view of the dispensing closure and dispensing valve, with the valve shown in a fully open and fully extended position.
Figure 6:
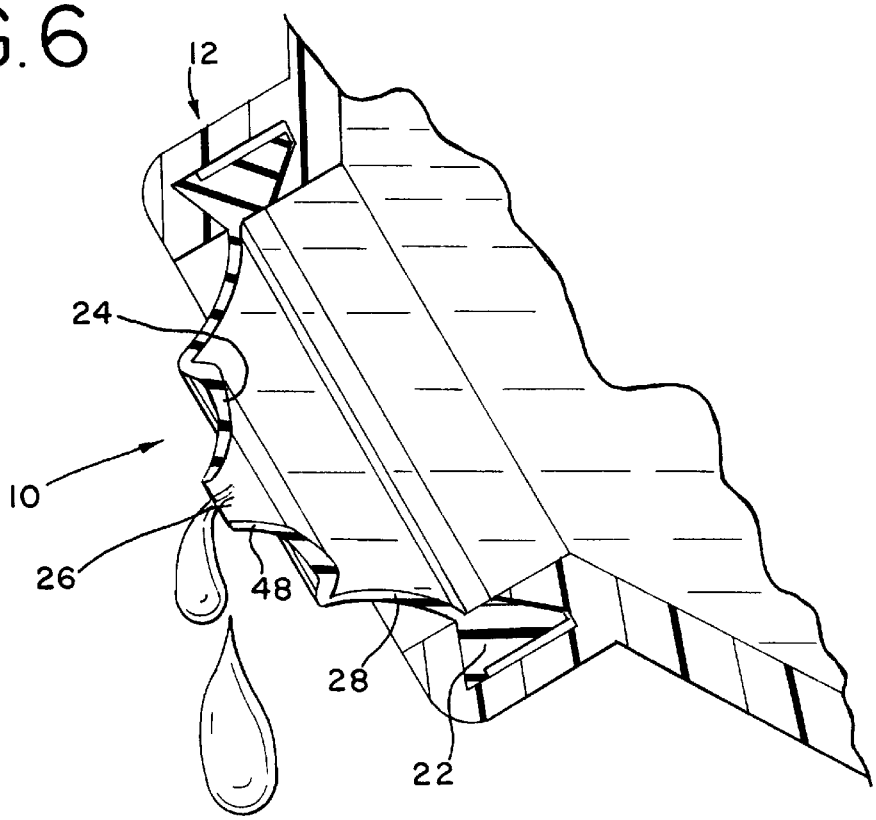
FIG. 6 is a fragmentary cross-sectional view of the dispensing closure and dispensing valve shown in an inclined orientation dispensing a liquid, with the valve shown in a fully open and fully extended position.

The configuration of connector sleeve 28 is such that reduced pressure is required to cause the valve head to drop from its fully closed position in FIG. 1 to its fully closed and fully extended to its position in FIG. 3 (drop pressure) and to move into its open position in FIG. 5 (open pressure). This results in a more controlled dispense and allows for more dispensing options, particularly for dispensing products like baby powder.

Additionally, the configuration of connector sleeve 28 results in a greater ratio between the drop pressure and the open pressure that creates a more desirable dispensing action of thin liquids by eliminating product stream misdirection as the valve head 24 rolls forward. An exemplary valve 10, in accordance with the invention, has a drop pressure at about 3 inches of water and an open pressure at about 9 to 17 inches of water. Also, the configuration of connector sleeve 28 creates more clearance for the product stream so that when the valve head 24 retracts, at the end of the dispensing cycle, product has less chance of catching the connector sleeve, especially if the container and valve 10 is held by the user at an angle from vertical (see FIG. 6).

The thickness of the valve head 24 and length of the valve slits 46 can be selected so that the open valve either snaps closed when the pressure differential decreases to a predetermined level or remains fully open even when the pressure differential drops to zero.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening;

a head portion that (1) is laterally inwardly of said marginal portion, (2) has an exterior side for interfacing with ambient environment, and (3) has an interior side for interfacing with the product in part of said interior side defining a peripheral surface corresponding to the peripheral thickness of said head portion, said head portion exterior side having a generally concave shape when viewed from outside the container, said head portion having a normally retracted position and having an extended position under the influence of a pressure differential, said head portion including an orifice which is normally closed when said head portion is in said retracted position and which opens to permit flow therethrough in response to a pressure differential across said valve when said head portion is in said extended position; and a resilient, flexible, connector sleeve extending continuously laterally and inwardly from said marginal portion to said head portion exterior side at said peripheral surface of said head portion, said connector sleeve positioning said head portion further inwardly relative to said container discharge opening than said marginal portion of said valve when said head portion is in said retracted position, said connector sleeve having an interior surface which interfaces with said product and which has (1) a concave curvature facing said product when said head portion is in said retracted position, and (2) a convex curvature facing said product when said head portion is in said extended position.

2. The dispensing valve in accordance with claim 1 in which said valve is mounted in a dispensing closure that is separate from, but releasably attachable to, said container around said opening.

3. The dispensing valve in accordance with claim 2 in which said dispensing closure includes a housing for mounting to said container; and said valve marginal portion is clamped by said housing.

4. The dispensing valve in accordance with claim 3 in which said valve marginal portion includes an annular flange having a dovetail cross-section defining a first diverging surface, a second diverging surface, and a peripheral surface between said first and second diverging surfaces; and said closure housing has a central opening surrounded by an annular, frustoconical clamping surface engaging said first diverging surface of said valve flange.

5. The dispensing valve in accordance with claim 1 in which said orifice is defined by a plurality of slits that extend (1) through said head portion between said exterior side to said interior side, and (2) laterally from a common origin whereby flaps are defined by said slits, said orifice opening by outward displacement of said flaps when the pressure in the interior of the container exceeds the pressure on the exterior of the valve by a predetermined amount;

said slits are each planar; and each slit defines a linear locus along said head portion exterior side and along said head portion interior side.

6. The dispensing valve in accordance with claim 1 in which said orifice is defined by a plurality of slits that extend (1) through said head portion between said exterior side to said interior side, and (2) laterally from a common origin whereby flaps are defined by said slits, said orifice opening by outward displacement of said flaps when the pressure in the interior of the container exceeds the pressure on the exterior of the valve by a predetermined amount; and said slits are of equal length.

7. The dispensing valve in accordance with claim 1 in which said orifice is defined by a plurality of slits that extend (1) through said head portion between said exterior side to said interior side, and (2) laterally from a common origin whereby flaps are defined by said slits, said orifice opening by outward displacement of said flaps when the pressure in the interior of the container exceeds the pressure on the exterior of the valve by a predetermined amount; and said slits are each planar and diverge radially from said origin to define equal size angles between each pair of adjacent slits.

8. The dispensing valve in accordance with claim 1 in which said orifice is defined by a plurality of slits that extend (1) through said head portion between said exterior side to said interior side, and (2) laterally from a common origin whereby flaps are defined by said slits, said orifice opening by outward displacement of said flaps when the pressure in the interior of the container exceeds the pressure on the exterior of the valve by a predetermined amount; and there are four of said slits diverging radially from said origin at 90° angles to define two mutually perpendicular, intersecting, longer slits.

9. The dispensing valve in accordance with claim 1 in which said head portion has a laterally outwardly flared crown shape defined, at least in part, by said outer peripheral surface which tapers laterally inwardly to prevent nesting with another, identical valve during handling.

10. The dispensing valve in accordance with claim 1 in which the thickness of said sleeve is substantially uniform.

11. The dispensing valve in accordance with claim 10 in which the thickness of said sleeve is about 0.011 inches.

12. The dispensing valve in accordance with claim 1 in which (1) said orifice closes when the pressure on the interior of the container does not exceed the pressure on the exterior of the valve, and (2) said connector sleeve has a configuration which applies an outwardly directed torque to said valve head portion when the differential between the pressure within the container and the pressure on the exterior of the valve exceeds a predetermined amount.

13. The dispensing valve in accordance with claim 1 in which said head portion interior side has a planar central area and a generally curved, radially outer portion which tapers toward said planar central area such that said exterior and interior sides converge toward said planar central area to provide a tapered construction with reduced thickness.

14. The dispensing valve in accordance with claim 1 in which said sleeve is generally arcuately shaped in longitudinal cross-section.

15. The dispensing valve in accordance with claim 14 wherein said sleeve defines a generally curved radius to present about a 45 degree angle to the general direction of flow through the valve when pressure is applied to it.

16. The dispensing valve in accordance with claim 1 wherein said sleeve has an interior surface that is substantially contiguous with said peripheral surface of said head portion.

* * * * *